United States Patent [19]

Kniepkamp

[11] 4,010,667

[45] Mar. 8, 1977

[54] RHYTHM UNIT WITH PROGRAMMED ENVELOPE WAVEFORM, AMPLITUDE, AND THE LIKE

[76] Inventor: Alberto E. Kniepkamp, 31 N. Prindle, Arlington Heights, Ill. 60004

[22] Filed: Aug. 28, 1975

[21] Appl. No.: 608,624

Related U.S. Application Data

[63] Continuation of Ser. No. 389,342, Aug. 17, 1973, abandoned.

[52] U.S. Cl. ..... 84/1.03; 84/1.24; 84/1.26; 84/1.13; 84/DIG. 12

[51] Int. Cl.² ..... G10F 1/00

[58] Field of Search ..... 84/1.03, 1.13, 1.24, 84/1.26, DIG. 12, 1.01, 1.11, 1.12, 1.19, 1.21

[56] References Cited

UNITED STATES PATENTS

| | | | |
|---|---|---|---|
| 3,518,352 | 6/1970 | Plunkett | 84/1.03 |
| 3,549,776 | 12/1970 | Shiga et al. | 84/1.03 |
| 3,637,914 | 1/1972 | Hiyama | 84/1.03 |
| 3,808,348 | 4/1974 | Okudaira | 84/1.03 |
| 3,861,263 | 1/1975 | Okudaira | 84/1.24 X |

*Primary Examiner*—Ulysses Weldon
*Attorney, Agent, or Firm*—Hill, Gross, Simpson, Van Santen, Steadman, Chiara & Simpson

[57] ABSTRACT

A rhythm unit produces repetitive pulses having one of a plurality of selectable predetermined time relations to each other for use as rhythm or accompaniment signals in an electronic organ or the like. Each of the pulses triggers operation of a modulator for modulating accompaniment tones in time with pulses produced by the rhythm unit, in correspondence with a programmed pattern. The shape of the modulated envelope waveform, its amplitude, and its frequency composition are programmed in accordance with a prearranged sequence, to give the desired sound characteristic within each of a plurality of individually selectable rhythms.

22 Claims, 8 Drawing Figures

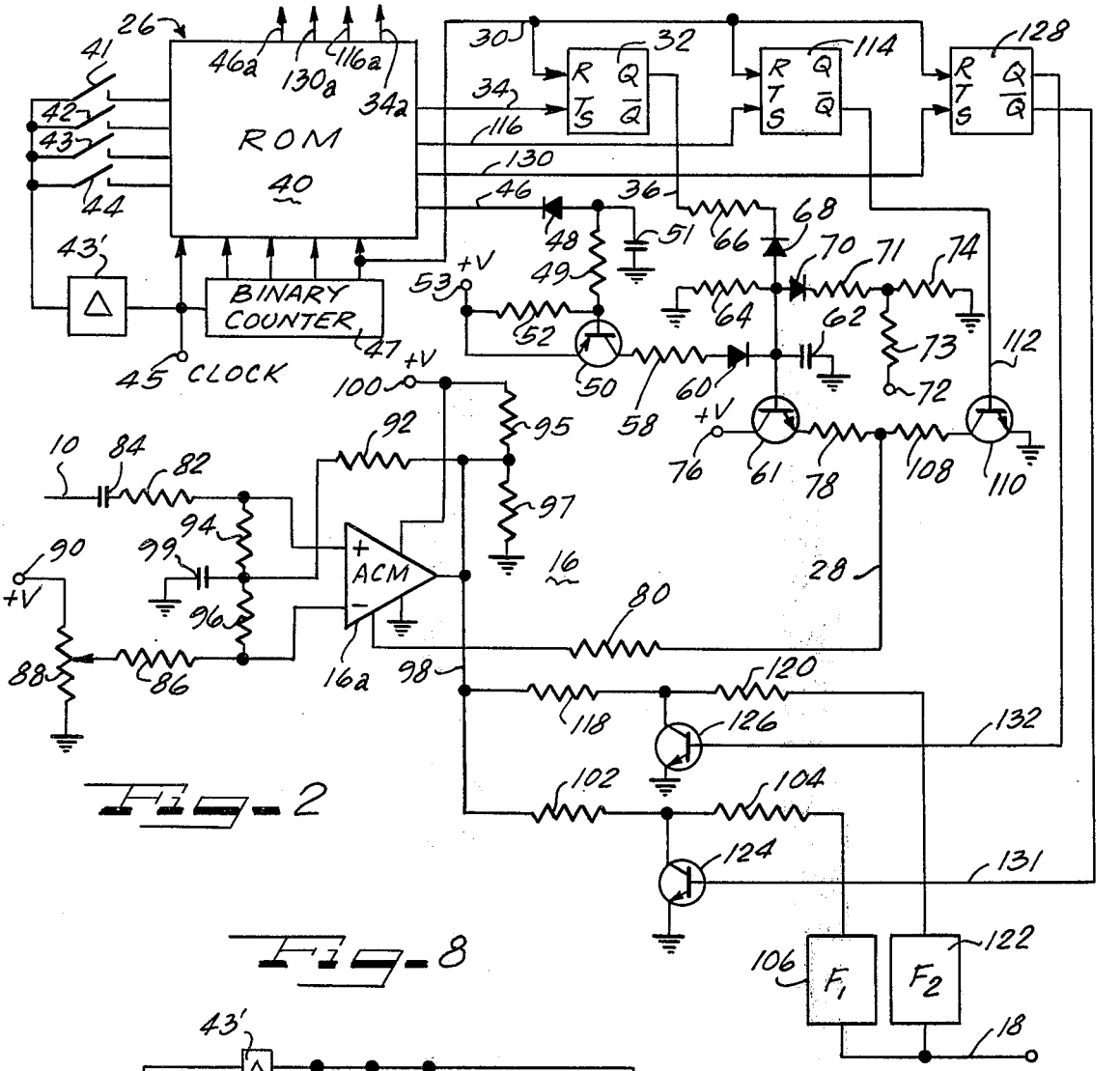
Fig. 2
Fig. 8
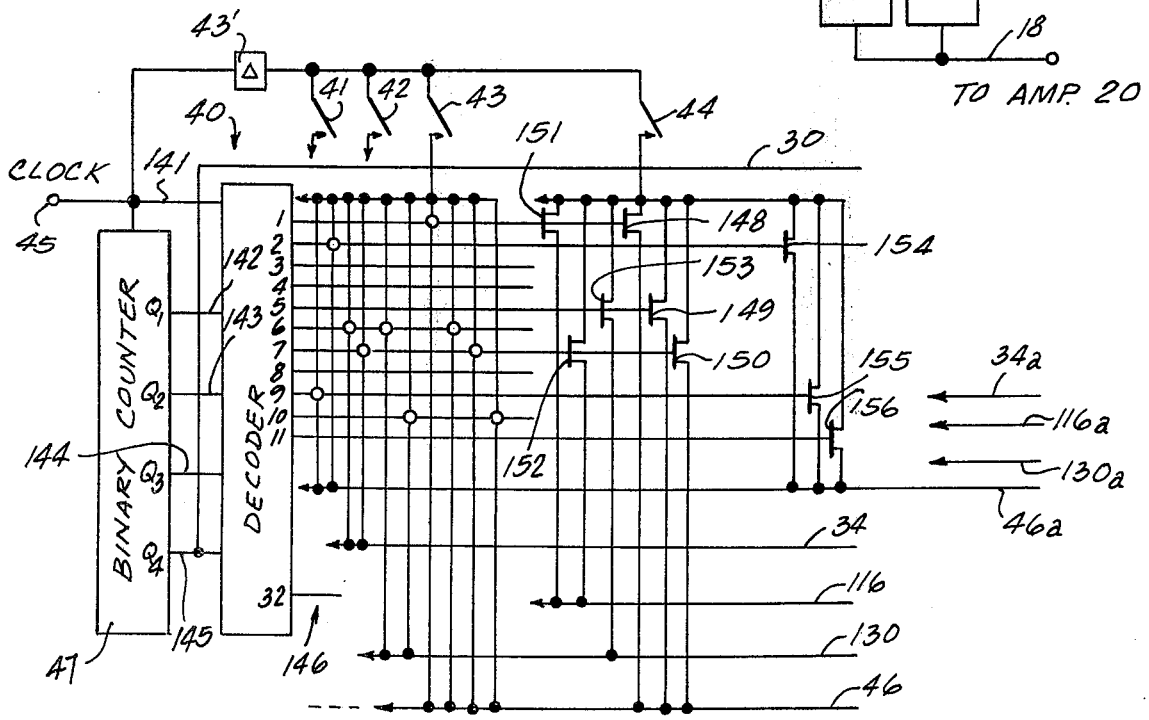

RHYTHM UNIT WITH PROGRAMMED ENVELOPE WAVEFORM, AMPLITUDE, AND THE LIKE

This is a continuation, of application Ser. No. 389,342, filed Aug. 17, 1973 now abandoned.

BACKGROUND

1. Field of the Invention

The present invention relates to a rhythm unit employed in association with an electronic organ or the like, and, more particularly, to a rhythm unit having a modulator programmed to select a predetermined envelope for the modulated signal, a predetermined amplitude, and a predetermined timbre or tonality.

2. The Prior Art

It is conventional in electronic organs to provide a rhythm unit in the form of a repetitively operating pulse generator or the like, for continuously producing series of timed pulses in repetitive cycles. The pulses are employed for triggering the operation of generators or keyers so as to produce accompaniment sounds, such as bongos, brushes, blocks, etc., at characteristic times within each cycle of operation of the rhythm unit. Heretofore, rhythm units have operated the various generators and keyers in precisely the same way each time such a unit is operated. The envelope waveform of the signal produced by the generator or keyer, the amplitude of such signal, and the frequency composition of such signal is the same each time such signal is produced. This leads to a sound characteristic which may be described as "mechanical" in the sense that sound characteristic is artificial sounding and lacking in variety. Such a sound characteristic does not simulate a "live" rhythm generated by a number of musical instruments played by musicians.

SUMMARY OF THE INVENTION

In one embodiment of the present invention, there is provided a musical instrument associated with a rhythm unit for generating a modulated tone signal having an envelope selected in response to pulses occurring at predetermined times in each cycle of operation of the rhythm unit, and control means responsive to certain ones of such pulses for modifying the shape of the envelope, whereby the shape of the modulated envelope is dependent upon the time at which each of such pulses occurs.

In another embodiment of the present invention, there is provided a rhythm unit having means for selectively controlling the amplitude of pulses occuring at predetermined times, whereby the amplitude of such pulses is dependent upon the time at which each of such pulses occurs.

In a further embodiment of the present invention, there is provided a rhythm unit having means for selectively controlling the connection of pulses occurring at predetermined times to one of several voicing units, whereby the frequency composition of signals modulating the selected waveforms is dependent upon the time at which each such pulse occurs.

It is accordingly, a principal object of the present invention to provide means for programming individual characteristics of sounds in response to the various pulses produced during operation of the rhythm unit.

Another object of the present invention is to provide a means for programming the amplitude produced in response to various pulses produced during operation of the rhythm unit.

A further object of the present invention is to provide a means for programming the shape of the waveform produced in response to various pulses produced during operation of the rhythm unit.

Another object of the present invention is to provide means for programming the voicing of sounds produced in response to various pulses produced during operation of the rhythm unit.

These and other objects and advantages of the present invention will become manifest upon an examination of the following description and the accompanying drawings.

BRIEF DESCRIPTION OF THE DRAWINGS

Reference will now be made to the accompanying drawings in which:

FIG. 2 is a schematic circuit diagram, partly in functional block diagram form, illustrating the details of the portion of the apparatus illustrated in FIG. 1;

FIG. 8 is a schematic circuit diagram further illustrating a portion of the apparatus of FIG. 2.

DESCRIPTION OF THE PREFERRED EMBODIMENT

Figures 1, 3, 4, 5, 6, 7:
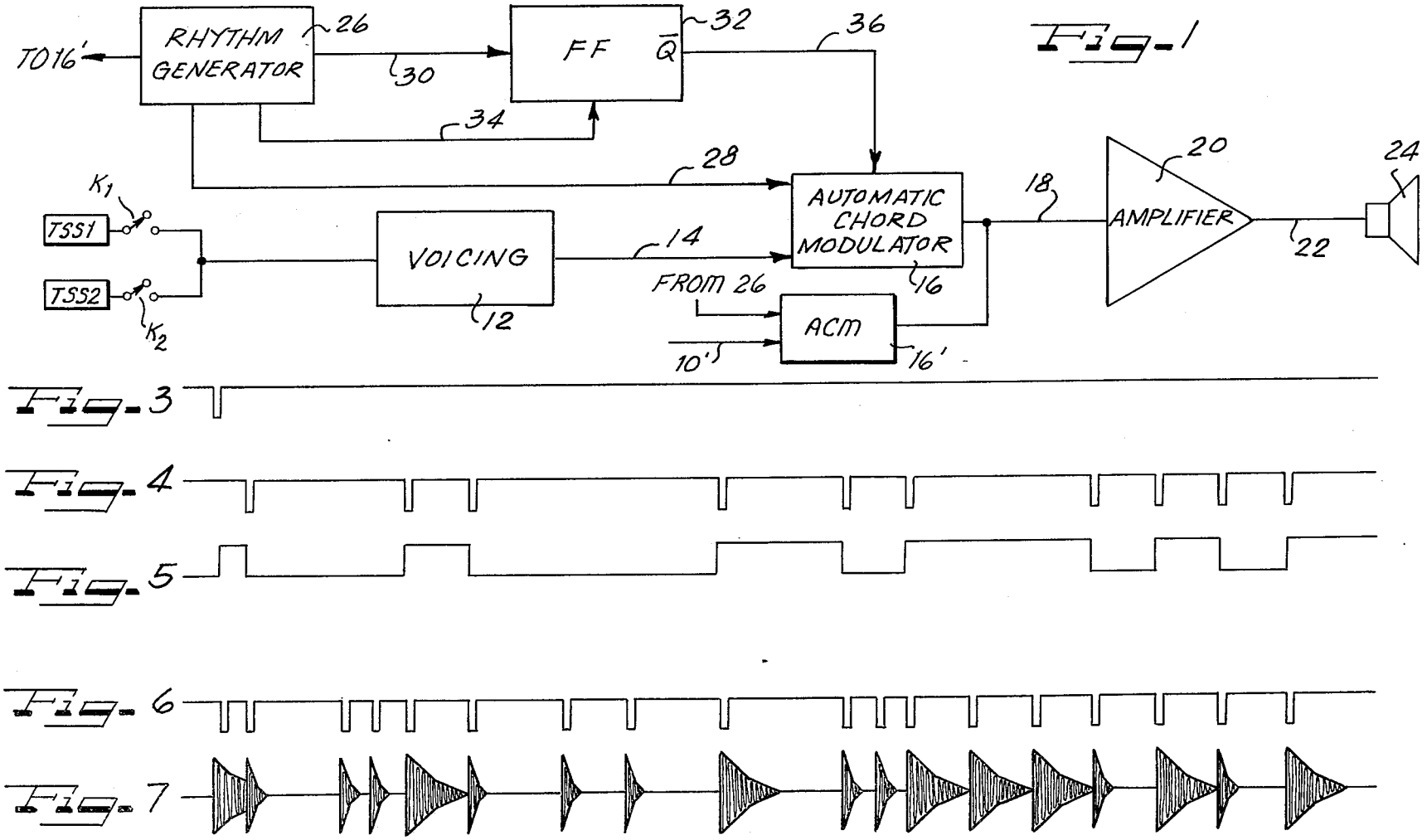
FIG. 1 is a functional block diagram of a portion of an electronic organ incorporating an illustrative embodiment of the present invention.
FIGS. 3–7 are graphs of waveforms illustrating operation of various portions of the system of FIG. 1.

Referring first to FIG. 1, a functional block diagram of a portion of an electronic organ incorporating an exemplary embodiment of the present invention is illustrated. A collector bus or line 10 is connected from the various keys of the electronic organ to the input of a voicing unit 12, and the output of the voicing unit 12, made up of signals which are sometimes hereinafter referred to as tone signals, is connected by a line 14 to the input of an automatic chord modulator 16. The output of the modulator 16, made up of signals sometimes hereinafter referred to as output tone signals, is connected by a line 18 to an input of an amplifier 20, and the output of the amplifier 20 is connected by a line 22 to a loudspeaker 24.

The interconnection of the key switches of the organ with the line 10 is conventional and is therefore not described in detail herein.

A rhythm generator 26 produces a plurality of pulses on an output line 28. The output line 28 is connected to an input of the automatic chord modulator 16 and functions to cause the modulator 16 to modulate the amplitude of the tone signal supplied over the line 14, in response to each pulse supplied over the line 28. The output tone signals on the line 18 thus comprise modulated envelopes of the tone signals on the line 14.

The output tone signals are supplied to the amplifier 20 over the line 18, and provide characteristic sounds when converted into sound by means of the loudspeaker 24. The pulses supplied by the rhythm generator 26 on the line 28 are produced in accordance with a selected rhythm, such as swing, waltz, rhumba, etc. The pulses on the line 28 are produced in repetitive cycles, with the pulses being spaced relative to each other in a manner characteristic of the rhythm which is selected.

Another output of the rhythm generator 26 is connected over a line 30 to the reset input of a flip-flop 32.

A further output of the rhythm generator 26 is connected to the toggle input of the flip-flop 32 by a line 34. The $\overline{Q}$ output of the flip-flop 32 is connected with the automatic chord modulator 16 over a line 36. The signal on the line 36 reflects the state of the flip-flop 32. When the flip-flop 32 is reset, as it is immediately following a pulse conveyed over the line 30, the line 36 has a relatively high voltage level thereon. When the state of the flip-flop 32 has been changed, however, in response to a pulse on the line 34, a relatively low voltage level appears on the line 36. Each time the state of the flip-flop 32 is changed in response to a pulse on the line 34, the voltage level on the line 36 alternates between its higher and lower levels.

In one embodiment of the present invention, the line 36 is connected to control the waveshapes of the output tone signals produced by the chord modulator 16, and functions to modify the time constant of the trailing edge of the output tone signal waveforms. When the flip-flop 32 is in its reset state, the modulator 16 produces output tone signals having a gradually falling trailing edge, and when the flip-flop 32 is in its other state, the trailing edge decay characteristic is much steeper, resulting in a shorter output tone signal.

The waveforms of FIGS. 3–7 illustrate the function of the flip-flop 32 and the manner in which the waveform of the output tone signals is affected. FIG. 3 illustrates the pulse, produced during each cycle of the rhythm generator 26, which is supplied to the line 30 for resetting the flip-flop 32. The waveform of FIG. 4 illustrates the pulses produced by the rhythm generator 36 on the line 34, for causing the flip-flop 32 to alternate or toggle between its two stable states. The waveform of FIG. 5 is the output produced by the $\overline{Q}$ output of the flip-flop 32, which is made available to the line 36. As illustrated in FIG. 5, the $\overline{Q}$ output goes high in response to the pulse on the line 30, and alternates between a low and high condition for each successive pulse on the line 34. FIG. 6 illustrates the pulses, supplied by the rhythm generator 26 to the line 28, which cause the modulator 16 to produce output tone signals, and the output tone signals produced by the modulator 16 on the output line 18 are shown by the waveform of FIG. 7.

The output tone signals each have an envelope with a relatively steep leading edge and a sloping trailing edge, the envelope containing a plurality of cycles of a tone signal. When the flip-flop 32 is in its reset condition, corresponding to a high level of the waveform of FIG. 5, the trailing edge of the output tone signal produced by the modulator 16 decreases relatively gradually, but decreases much more rapidly when the flip-flop 32 is in its set condition, corresponding to the lower level of the waveform of FIG. 5. Accordingly, the shape of the output tone signals on the line 18 is modified in response to operation of the flip-flop 32. The selection of the output tone signals having the two separate decay characteristics is controlled entirely by the pulses on the line 34, as shown in FIG. 4.

Referring now to FIG. 2, which is a schematic circuit diagram of a portion of the apparatus illustrated in FIG. 1, the rhythm generator unit 26 is illustrated in the form of a read-only-memory or ROM 40. The ROM has a plurality of input terminals connected individually through switches 41–44 through a delay unit 43′ to a source of clock pulses present at a terminal 45. The delay unit 43′ insures that the levels on the select inputs of the ROM 40 are not changing when pulses are passed through the switches 41–44. One of the switches is closed when the rhythm unit is to be used, and a series of pulses appears on an output line 46, which are spaced to define the rhythm selected by one of the switches 41–44. A binary counter 47 is also supplied with clock pulses from the terminal 45, as more fully described hereinafter. During each cycle, a plurality of rhythm pulses are produced on the output line 46 and are connected through a diode 48 and through a resistor 49 to the base of a transistor 50. The junction of the diode 48 and the resistor 49 is connected to ground through a capacitor 51, and a second resistor 52 connects the base of the transistor 50 to a source of positive potential at a terminal 53, to provide bias to the transistor 50. The emitter of the transistor 50 is connected to the terminal 53; the collector of the transistor 50 is connected through a resistor 58 and a diode 60 to the base of a transistor 61, and to ground through a capacitor 62. The pulses produced on the output line 46 by the ROM 40 are negative-going pulses (as shown in FIG. 4) and appear at the time each of the output tone signals is desired.

Each negative-going pulse discharges the capacitor 51 and drives the transistor 50 into conduction. The transistor 50 then charges the capacitor 62 through the resistor 58 and the diode 60. The charging of the capacitor 62 furnishes the relatively steep rising leading edge of the output tone signals illustrated in FIG. 7.

The time required for the discharge of the capacitor 62 to occur depends upon the circuit time constant, which is the product of the capacitance of the capacitor 62 and the effective value of resistance in the circuit. The circuit resistance is made up of a resistor 64, connected in parallel with the capacitor 62, and a network including a diode 70 and a resistor 71 connected in series between the ungrounded terminal of the capacitor 62 and the output of a voltage divider connected between a source of positive voltage at a terminal 72 and ground, and including series connected resistors 73 and 74. When the capacitor 62 has been discharged to the level established by the voltage divider, the diode 70 becomes back biased, and the circuit resistance is then supplied entirely by the resistor 64, which provides a reduced rate of discharge thereafter. The resistor 64 and the network including the diode 70 are responsible for the longer output tone signals illustrated in FIG. 7.

The toggle input of the flip-flop 32 is connected to the ROM 40 in the same manner as illustrated in FIG. 1, namely, by the line 34, and functions to produce a waveform on the $\overline{Q}$ output line 36 corresponding to that illustrated in FIG. 5. The line 30 is connected from the Q4 output of the binary counter 47, to reset the flip-flop once during each cycle when the Q4 output goes low. The $\overline{Q}$ output of the flip-flop 32 is connected by the line 36 through a resistor 66 and a diode 68 to the junction of the diode 60 and the capacitor 62. Accordingly, when the $\overline{Q}$ output of the flip-flop 32 has a low potential, the capacitor 62 is discharged more rapidly, as some current is drawn through the diode 68 and the resistor 66, serving to hasten the discharge of the capacitor 62 and to shorten the trailing edge of the output tone signals.

The collector of the transistor 61 is connected to a source of positive voltage at a terminal 76, and its emitter is connected to the output line 28 by a resistor 78. The line 28 is connected to an input of the automatic chord modulator 16 by a resistor 80.

The automatic chord modulator 16 preferably comprises an integrated circuit or IC 16*a*, such as the model CA3080A, marketed by Radio Corporation of America. This IC comprises a variable gain differential amplifier, with the gain being determined by the bias level supplied to the terminal which in FIG. 2 is shown connected to the resistor 80.

The non-inverting input of the modulator IC 16*a* is connected to the input line 10 through a resistor 82 and a capacitor 84, and the inverting input is connected by a resistor 86 to the tap of a potentiometer 88, which has its end terminals connected between ground and a source of positive voltage at a terminal 90. The tap of the potentiometer is adjusted to produce the desired quiescent voltage level on the output line 98 of the modulator IC 16*a*. The voltage gain of the modulator 16*a* is controlled by a load resistor 92, connected from the output line 98 to one end of each of two resistors 94 and 96, the other ends of which are connected respectively to the non-inverting and inverting inputs of the modulator IC 16*a*. A bypass capacitor 99 is connected to ground from the common terminals of the resistors 94 and 96. The modulator IC 16*a* has power supply terminals connected to a source of positive voltage at a terminal 100 and to ground, respectively, in conventional fashion. A voltage divider, incorporating two resistors 95 and 97 of equal value, is connected between the terminal 100 and ground, to establish a reference voltage for both inputs of the IC 16*a* midway between ground and the voltage present at the terminal 100.

The output line 98 of the modulator IC 16A is connected through a pair of series connected resistors 102 and 104 and through a first filter circuit 106 to the output line 18, which leads to the amplifier 20 (FIG. 1). The filter circuit 106 functions to modify the frequency composition of the output tone signals, and thereby affects the voice of sounds produced by the loudspeaker 24.

The circuit of FIG. 2, as thus far described, is effective to change the shape of the waveform of the output tone signals, as shown in FIG. 7, in response to pulses supplied to the flip-flop 32. The amplitude of each of the output tone signals remains constant, as shown in FIG. 7, and the voicing is constant, as affected by the filter circuit 106. The operation of the circuit in modifying the amplitude and voice of the output tone signals will now be described.

The line 28 is connected by a resistor 108 to the collector of a transistor 110, the emitter of which is grounded. When a relatively low potential is applied to the base of the transistor 110, it is cut off and has no effect on the operation of the circuit as described above. However, when a higher potential is applied to the base of the transistor 110, current is drawn from the line 28 through the resistor 108 to ground, and lowers the amplitude of the signal applied to the modulator IC 16*a*. The base of the transistor 110 is connected by a line 112 to the Q output of a flip-flop 114. The flip-flop 114 has its reset input connected to the line 30 for resetting the flip-flop 114 at the beginning of each cycle, and the toggle input of the flip-flop 114 is connected to an output of the ROM 40 by a line 116. The line 116 is energized in the same manner as the line 34, but at times which are programmed by the construction of the ROM, as described in more detail hereinafter. Accordingly, the flip-flop 114 changes its state in response to each pulse appearing on the line 116, with the result that the amplitude of the signals on the line 28 is modified in accordance with the state of the flip-flop 114, which is dependent on the time of occurrence of pulses on the line 116. Thus, when it is desired to produce some of the output tone signals with reduced amplitude, a pulse is provided on the line 116 coincidently with a rhythm pulse on the line 28, and the amplitude of the output tone signal corresponding to that rhythm pulse is reduced, as are all subsequent rhythm pulses, until the flip-flop 114 is again reset.

A muting transistor 124 has its collector connected to the junction of the resistors 102 and 104, and its emitter is grounded. When the transistor 124 has a relatively low potential applied to its base, it is cut off and the operation is the same as described above.

The line 98 is connected through series connected resistors 118 and 120 and a second filter circuit 122 to the output line 18. A second muting transistor 126 has its collector connected to the junction of the resistors 118 and 120 and its emitter connected to ground. When a relatively high potential is applied to the base of the transistor 126, it is saturated, and the filter 122 receives no signal.

A flip-flop 128 has its $\overline{Q}$ output connected to the base of the transistor 124 by a line 131 and its Q output connected to the base of the transistor 126 by a line 132. Thus, one of the transistors 124 and 126 is cut off and the other is saturated, in accordance with the state of the flip-flop 128. The reset terminal of the flip-flop 128 is connected to the line 30, so it is reset at the beginning of each cycle, and the toggle input of the flip-flop 128 is connected to the ROM 40 by a line 130. The state of the flip-flop 128 is determined by the pulses produced on the line 130 and, accordingly, connects the signal on the line 98 either through the first filter 106, when the flip-flop 128 is reset, or through the filter 122, when the flip-flop 128 is set. This changes the voicing of the output tone signals, and so the voicing is controlled by the ROM 40, which programs the timing of the pulses produced on the line 130.

It will be understood by those skilled in the art that, although filter circuits 106 and 122 are shown, to illustrate different voices, either or both of these filter circuits may be omitted, if desired.

Referring to FIG. 8, a functional diagram illustrative of the ROM 40 is shown, together with the binary counter 47, which has been mentioned above. The ROM is preferably an integrated circuit having, in the example illustrated in FIG. 8, five binary coded select inputs 141–145 connected to the clock terminal 45 and to the four Q outputs of a four-stage binary counter which comprises the driver 47. A decoder unit 146, embodied within the integrated circuit, decodes the binary representation on the lines 141–145 and energizes one of 32 lines 146. The lines 146 are energized one at a time in sequence at the rate of the clock pulses supplied to the terminal 45, which is variable to produce slow and fast rhythms, as desired. Some of the lines 146 are connected to gates to field effect transistors, or FET's, and the FET's are associated in groups, with the drain and source terminals of all of the FET's in a given group being connected in common. Thus, the FET's 148–150 have their drain and source terminals connected in common, extending between the rhythm pulse line 46 and the switch 44. The switch 44, when closed, connects the clock terminal 45 to the group containing the FET's 148–150 through the delay device 43′, so that all of the FET's in that group are conditioned to pass a pulse to the line 46, provided that a gate terminal is energized by one of the lines 146. The lines 146 are energized in sequence during each cycle, and, after the line 30 is energized, the first, fifth, and seventh ones of the lines 146 are connected respectively to the FET's 148, 149, and 150, so that pulses are produced on the line 46 at times 1, 5, and 7 each cycle while the switch 44 is closed. Another group including the FET's 151 and 152 have their drain and source terminals connected in common between the switch 44 and the line 116. The gates of these FET's are respectively connected to the first and seventh ones of the lines 146, so that the flip-flop 114 is toggled at these pulse times each cycle. One further FET 153 has its drain and source terminals connected between the switch 44 and the line 130 and its gate connected to the fifth line 146, so that the flip-flop 128 is toggled at the fifth pulse time during each cycle. No FET's connect the switch 44 to the line 34, and so the flip-flop 32 remains reset during the entire operation when the switch 44 is selected.

The FET's connected with the switch 43 are shown diagramatically in FIG. 8 by circles linking various ones of the lines 146 between the switch 43 and the output lines 46, 34, and 130. No pulses are provided to the line 116 when the switch 43 is operated, and so the flip-flop 114 remains reset when the switch 43 is selected. The different connections to the lines 146 for the FET's connected between the switch 43 and the line 46 indicate a different rhythm from that produced when the switch 44 is closed. When both switches 43 and 44 are closed, a composite of both rhythms is produced, but the toggle inputs to the flip-flops 32, 114, and 128 modify the composite considerably from either of the two rhythms selected individually by the switches 43 and 44.

It will be understood by those skilled in the art that further groups of FET's (not shown) interconnect the switches 41 and 42 with the various output lines 34, 46, 116, and 130, in accordance with other rhythms selectable by those switches. In addition, further FET's may be included in the circuits illustrated as connected with the switches 43 and 44, as desired.

A further group of FET's 154–156 is interconnected between the switch 44 and a line 46*a*, and another group of FET's (illustrated by circles) connects the switch 43 with the line 46*a*. The line 46*a* is a rhythm pulse output line, like the line 46, but is connected to an individual modulator (not shown), like the modulator IC 16*a*, which has its input line connected to a different tone signal source from the modulator IC 16*a*, and thus produces the sound of a different instrument. It is apparent from the gate connections of the FET's 154–156 that at least some of the pulses produced on the line 46*a* occur at different times from those appearing on the line 46, and so the instrument sounds produced in response to pulses on the lines 46 and 46*a* occur at different times within each cycle of the rhythm. Other groups of FET's (not shown) are connected between the switches 43 and 44 and the control lines 34*a*, 116*a*, and 130*a*, which are connected with control flip-flops (not shown) for the second instrument. Similarly, still other groups of FET's are connected between the other rhythm selecting switches and the lines 34*a*, 116*a*, 130*a*, and 46*a*, so that the second instrument is controlled in the desired fashion irrespective of the particular rhythm which is selected. Of course it will be understood by those skilled in the art that the number of separate instruments which can be controlled by separate rhythm pulse lines like the lines 46 and 46*a* is not limited to two, but as many instruments as desired may be accommodated simply by providing a large enough ROM.

The arrangement of the ROM in FIG. 8 is merely diagrammatic to illustrate the operation and function of the ROM and does not necessarily correspond to its structure. ROM's are commercially available from a number of semiconductor manufacturers, such as American Micro-Systems, Inc., and are constructed in accordance with any program the customer designates. The details of ROM construction form no part of the present invention. If desired, the ROM may be made from discrete components arranged as illustrated in FIG. 8.

The specific program embodied in the construction of the ROM, including the rhythm pulses produced on the line 46 and the various toggle pulses produced on the lines 34, 116, and 130, is a matter of design choice, and conforms to the individual musical preferences of the designer. The size of the ROM may be made large enough to accommodate any number of rhythms and need not be limited to the arrangement shown in the drawings, which has only four rhythm selecting switches 41–44.

The voicing unit 12 (FIG. 1) may be omitted if desired, with all of the voicing functions being performed by voicing units like the filters 106 and 122 (FIG. 2).

The tone signals applied to the line 10 are preferably those which may be referred to as accompaniment tones, meaning those selected by means of the key operated switches associated with the left-hand or lower part of a single manual, or with a separate left-hand manual, or switches associated with a group of chord buttons selectable by the player-operator of the instrument. These switches complete connections from tone signal sources to the line 10. In most cases, it is desirable to cause the solo or melody signals to be connected to the amplifier 20 independently of the apparatus illustrated in the drawings, and the switches operated by the pedals of the instrument, if any, are also ordinarily connected to the output system directly. However, when accented solo notes (or bass notes) are desired, the solo and pedal switches may also be connected to the line 10.

Other modifications and changes in the present invention will be apparent to those skilled in the art, without departing from the essential features of novelty thereof, which are intended to be defined and secured only by the appended claims.

What is claimed is:

1. An electronic musical instrument comprising:

a. a sound output system including an amplifier and a loudspeaker, b. rhythm generator means for producing a series of pulses at times related to each other so as to form rhythm patterns, c. a tone signal source, d. modulator means connected with said tone signal source for modulating said tone signal in response to some of the pulses produced by said rhythm generator means, e. connecting means for connecting said modulator means with said amplifier, and f. control means connected to said rhythm generator and to said modulator means for generating one of a plurality of different envelope signals for said modulated tone signal in response to certain ones of said pulses and for generating another of said envelope signals in response to other of said pulses.

2. Apparatus according to claim 1, wherein said rhythm generator comprises a read-only-memory adapted to produce a series of pulses spaced in time in accordance with a specific rhythm, and including a source of clock pulses, and means connected with said source of clock pulses for driving said read-only-memory in repetitive cycles of operation.

3. Apparatus according to claim 2, including a plurality of switches for individually connecting selected portions of said read-only-memory to said clock pulse source for producing a sequence of time related pulses corresponding to a selected rhythm.

4. Apparatus according to claim 1, wherein said control means comprises a bi-stable device connected to said rhythm generator means for receiving certain ones of said pulses, the state of said bi-stable device alternating with each received one of said pulses.

5. Apparatus according to claim 1, including a plurality of tone signal sources for generating accompaniment tones, and switch means for selectively connecting one of said plurality of tone signal sources with said modulator.

6. Apparatus according to claim 1, including a plurality of tone signal sources, a plurality of modulators connected with different ones of said tone signal sources and each responsive to individual series of pulses produced by said rhythm generator means for modulating tone signals in response thereto, and a plurality of control means individually connected with some of said modulators and each connected with said rhythm generator means and responsive thereto for controlling the operation of said modulator.

7. Apparatus according to claim 1, wherein said control means includes waveform producing means having a capacitor, a charging current source, a first circuit connected to said charging current source and responsive to pulses from said rhythm generator for charging said capacitor at a first rate, and a second circuit for discharging said capacitor at a second rate different from said first rate, and means for modulating said tone signal in response to the charge on said capacitor.

8. Apparatus according to claim 7, including selectively operable means connected with said capacitor and with said rhythm generator for discharging said capacitor at a third rate, different from said first and second rates, in response to selected pulses from said rhythm generator.

9. An electronic musical instrument comprising:

a. a sound output system including an amplifier and a loudspeaker,
b. rhythm generator means for producing a series of pulses at times related to each other so as to form rhythm patterns,
c. a tone signal source,
d. modulator means connected with said tone signal source for modulating said tone signal in response to some of the pulses produced by said rhythm generator means,
e. connecting means for connecting said modulator means with said amplifier, and
f. control means connected to said rhythm generator and to said modulator means for controlling the amplitude of said modulated tone signal in response to certain ones of said rhythm-forming pulses.

10. Apparatus according to claim 9, including a plurality of tone signal sources, a plurality of modulators connected with different ones of said tone signal sources and each responsive to individual series of pulses produced by said rhythm generator means for modulating tone signals in response thereto, and a plurality of control means individually connected with some of said modulators and each connected with said rhythm generator means and responsive thereto for controlling the operation of said modulator.

11. An electronic musical instrument comprising:

a. a sound output system including an amplifier and a loudspeaker,
b. rhythm generator means for producing a series of pulses at times related to each other so as to form rhythm patterns,
c. a tone signal source,
d. modulator means connected with said tone generator means and with said rhythm generator means for modulating said tone signal in response to some of the pulses produced by said rhythm generator means,
e. a plurality of voicing units,
f. selectively operable connecting means responsive to some of the pulses produced by said rhythm generator means for connecting said modulator means with a selected one of said voicing units, and
g. connecting means for connecting said selected voicing unit to said amplifier.

12. Apparatus according to claim 11, wherein said selectively operable connecting means includes a plurality of gates, one for each of said voicing units, and control means connected with said rhythm generator means for selecting one of said gates for operation.

13. Apparatus according to claim 12, wherein said control means comprises a bi-stable device connected to said gates for operating one of said gates when said bi-stable device is in one of its stable states, and for operating the other gate when the bi-stable device is in its other stable state, and means for connecting said bi-stable device with said rhythm generator means, whereby said bi-stable device changes its state in response to certain ones of said pulses.

14. Apparatus according to claim 11, including a plurality of tone signal sources, a plurality of modulators connected with different ones of said tone signal sources and with said rhythm generator means and each responsive to individual series of pulses produced by said rhythm generator means for modulating tone signals in response thereto, a plurality of voicing units for each of at least some of said modulators, and a plurality of selectively operable connecting means for connecting each of some of said modulators with a selected one of its voicing units, in response to individual series of pulses from said rhythm generator means.

15. In a rhythm unit for an electronic musical instrument, the combination comprising:

a. an output terminal,
b. rhythm generator means for producing a series of pulses at times related to each other so as to form rhythm patterns,
c. a tone signal source,
d. modulator means connected with said tone signal source for modulating said tone signal in response to some of the pulses produced by said rhythm generator means,
e. connecting means for connecting said modulator means with said output terminal, and f. control means connected to said rhythm generator and to said modulator means for generating one of a plurality of different envelope signals for said modulated tone signal in response to certain ones of said pulses and for generating another of said envelope signals in response to others of said pulses.

16. In a rhythm unit for an electronic musical instrument, the combination comprising:

a. an output terminal,
b. rhythm generator means for producing a series of pulses at times related to each other so as to form rhythm patterns,
c. a tone signal source,
d. modulator means connected with said tone signal source for modulating said tone signal in response to some of the rhythm-forming pulses produced by said rhythm generator means,
e. connecting means for connecting said modulator means with said output terminal, and
f. control means connected to said rhythm generator and to said modulator for controlling the amplitude of said modulated tone signal in response to certain ones of said pulses.

17. In a rhythm unit for an electronic musical instrument, the combination comprising:

a. an output terminal,
b. rhythm generator means for producing a series of pulses at times related to each other so as to form rhythm patterns,
c. a tone signal source,
d. modulator means connected with said tone generator means and with said rhythm generator means for modulating said tone signal in response to some of the pulses produced by said rhythm generator means,
e. a plurality of voicing units,
f. selectively operable connecting means responsive to some of the pulses produced by said rhythm generator means for connecting said modulator means with a selected one of said voicing units, and
e. connecting means for connecting said selected voicing unit to said output terminal.

18. An electronic musical instrument comprising:

a. a sound output system including an amplifier and a loudspeaker,
b. rhythm generator means for producing a series of discrete, non-overlapping pulses at times related to each other so as to form rhythm patterns.
c. a tone signal source,
d. modulator means connected with said tone signal source for modulating said tone signal in response to some of the discrete, non-overlapping pulses produced by said rhythm generator means,
e. connecting means for connecting said modulator means with said amplifier, and
f. control means connected to said rhythm generator and to said modulator means for controlling the amplitude of at least a part of said modulated tone signal in response to certain ones of said discrete, non-overlapping pulses.

19. An electronic musical instrument comprising:

a. a sound output system including an amplifier and a loudspeaker,
b. rhythm generator means having a counter and decoding means responsive to said counter for producing a series of pulses at times related to each other so as to form rhythm patterns,
c. a tone signal source,
d. modulator means connected with said tone signal source for modulating said tone signal in response to some of the pulses produced by said rhythm generator means,
e. connecting means for connecting said modulator means with said amplifier, and
f. control means connected to said decoding means and to said modulator means for controlling the amplitude of at least a part of said modulated tone signal in response to certain ones of said rhythm-forming pulses.

20. An electronic musical instrument comprising:

a. a sound output system including an amplifier and a loudspeaker,
b. rhythm generator means for producing a series of pulses at times related to each other so as to form rhythm patterns.
c. a tone signal source,
d. modulator means connected with said tone signal source for modulating said tone signal in response to some of the pulses produced by said rhythm generator means,
e. connecting means for connecting said modulator means with said amplifier,
f. bi-stable means connected to said rhythm generator for receiving certain ones of said pulses and for changing its state in response to alternate ones of said pulses which are received, and
g. control means connected to said bi-stable means and to said modulator means for controlling the amplitude of at least a part of said modulated tone signal in response to the state of said bi-stable device.

21. An electronic musical instrument comprising:

a. a sound output system including an amplifier and a loudspeaker,
b. rhythm generator means for producing a series of short pulses at times related to each other so as to form rhythm patterns,
c. A tone signal source,
d. modulator means connected with said tone signal source for modulating said tone signal in response to some of the pulses produced by said rhythm generator means,
e. connecting means for connecting said modulator means with said amplifier, and
f. control means connected to said rhythm generator and to said modulator means for controlling the amplitude of at least a part of said modulated tone signal in response to certain ones of said pulses, whereby said modulated tone signal has a first envelope waveshape following a first of said pulses and a second envelope waveshape following a second of said pulses.

22. An electronic musical instrument comprising:

a. a sound output system including an amplifier and a loudspeaker,
b. rhythm generator means for producing a series of short pulses at times related to each other so as to form rhythm patterns,
c. a tone signal source,
d. modulator means connected with said tone signal source for modulating said tone signal in response to some of the pulses produced by said rhythm generator means,
e. connecting means for connecting said modulator means with said amplifier, and f. control means connected to said rhythm generator and to said modulator means for controlling the amplitude of said modulated tone signal in response to certain ones of said pulses, whereby said modulated tone signal has a first amplitude following a first of said pulses and a second amplitude following a second of said pulses.

* * * * *